US009976751B2

(12) United States Patent
Alonso Esteban et al.

(10) Patent No.: US 9,976,751 B2
(45) Date of Patent: May 22, 2018

(54) DOMESTIC APPLIANCE APPARATUS

(71) Applicant: BSH Bosch und Siemens Hausgeräte GmbH, Munich (DE)

(72) Inventors: Rafael Alonso Esteban, Huesca (ES); Carlos Heras Vila, Saragossa (ES); Eduardo Imaz Martinez, Tudela (ES); Sergio Llorente Gil, Saragossa (ES); David Paesa García, Saragossa (ES); Julio Rivera Peman, Cuarte de Huerva (ES); Iñigo Salinas Ariz, Saragossa (ES); Francisco Villuendas Yuste, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 199 days.

(21) Appl. No.: 14/423,146

(22) PCT Filed: Aug. 22, 2013

(86) PCT No.: PCT/IB2013/056798
§ 371 (c)(1),
(2) Date: Feb. 23, 2015

(87) PCT Pub. No.: WO2014/033593
PCT Pub. Date: Mar. 6, 2014

(65) Prior Publication Data

US 2015/0253014 A1 Sep. 10, 2015

(30) Foreign Application Priority Data

Sep. 3, 2012 (ES) ..... 201231357

(51) Int. Cl.
*H05B 3/68* (2006.01)
*F24C 7/08* (2006.01)

(52) U.S. Cl.
CPC ..... *F24C 7/083* (2013.01)

(58) Field of Classification Search
CPC ..... F24C 7/082; F24C 7/083; F24C 7/087; F24C 7/081; F24C 7/06; F24C 7/062;
(Continued)

(56) References Cited

U.S. PATENT DOCUMENTS 6,118,107 A * 9/2000 Kobrich ..... G01K 11/14 219/443.1
6,375,350 B1 4/2002 Stein
2009/0314771 A1* 12/2009 Okada ..... H05B 6/062 219/647

FOREIGN PATENT DOCUMENTS

DE 19654773 * 4/1998
EP 1865754 * 12/2007
(Continued)

OTHER PUBLICATIONS

International Search Report PCT/IB2013/056798 dated Mar. 10, 2014.

*Primary Examiner* — Shawntina Fuqua
(74) *Attorney, Agent, or Firm* — Michael E. Tschupp; Andre Pallapies; Brandon G. Braun

(57) ABSTRACT

A domestic appliance apparatus includes at least one light-guiding element, and at least one sensor unit having at least one light sensor and configured to detect light transmitted through the light-guiding element and to determine at least one temperature characteristic. The at least one sensor unit has at least one sensor element configured to determine at least one characteristic of the at least one light-guiding element.

37 Claims, 2 Drawing Sheets

(58) Field of Classification Search
CPC ..... F24C 15/105; F24C 15/106; G01K 11/14; H05B 3/74; H05B 6/062; H05B 2213/07; G01J 5/0003; G01J 5/08; G01J 5/0812; G01J 5/0893; G01J 5/0821; G01J 5/0803; G01J 5/0806; G01J 2005/068; G01J 2005/103
See application file for complete search history.

(56) References Cited

FOREIGN PATENT DOCUMENTS

| | | | | |
|---|---|---|---|---|
| EP | 1865754 | A2 | | 12/2007 |
| JP | 2003347028 | | * | 12/2003 |
| JP | 2003347028 | A | | 12/2003 |

* cited by examiner

DOMESTIC APPLIANCE APPARATUS

BACKGROUND OF THE INVENTION

The invention proceeds from a domestic appliance.

Hobs are known which use an infrared sensor for temperature determination. Here a temperature is assigned via a calibration table to a sensor measured value.

BRIEF SUMMARY OF THE INVENTION

The object of the invention especially consists of providing a generic apparatus with improved properties in respect of improved temperature determination. The object is achieved in accordance with the invention by the features of the invention.

The invention proceeds from a domestic appliance apparatus, especially a hob apparatus, with at least one light-guiding element and at least one sensor unit which has at least one light sensor and is provided to detect light transmitted through the light-guiding element and to determine at least one relevant temperature characteristic.

It is proposed that the sensor unit has at least one further sensor element which is provided to determine at least one characteristic of the at least one light-guiding element.

A "light-guiding element" is especially to be understood as an element which is at least partly transparent for electromagnetic radiation. That the element is "partly transparent" for electromagnetic radiation should especially be understood as the element, at least in a part range of the electromagnetic radiation, especially in a part range between 300 nm and 5 μm, advantageously at least in a part range between 900 nm and 3 μm, advantageously at least in a part range between 1.2 μm und 2.6 μm, especially in a part range with a width of at least 100 nm, advantageously at least 300 nm, preferably at least 500 nm, has a transparency of at least 30%, especially at least 50%, advantageously at least 70%. A "sensor unit" is especially to be understood as a unit having at least one sensor element. A "sensor element" is especially to be understood as an element which is provided to convert a physical variable to be determined, especially a temperature and/or at least one radiation characteristic, into at least one other, preferably electric, characteristic, especially a current, a voltage, a resistance, a capacitance and/or an inductance. Preferably the sensor unit has at least one, preferably electric, evaluation electronics unit, which is provided to measure the other, preferably electric, characteristic. In particular the evaluation electronics has at least one amplifier circuit. Advantageously the evaluation electronics is provided to convert the characteristic into a signal able to be evaluated for a control unit, advantageously a digital signal. A "light sensor" is especially to be understood as a sensor element which is provided to measure at least one characteristic of electromagnetic radiation. In particular the light sensor is provided to measure an intensity of incident infrared radiation. In particular the light sensor is embodied as a photodiode. In particular the light sensor is provided to measure light with wavelengths of smaller than 4 μm, especially smaller than 3 μm, advantageously smaller than 2.6 μm. In particular the sensor unit is provided to determine a relevant temperature characteristic of an object arranged optically behind the light element, especially a cooking vessel and/or items being cooked, as a relevant temperature characteristic. "Provided" should especially specifically be understood as programmed, designed and/or equipped. A "temperature characteristic" should especially be understood as a characteristic of which the value, at least between −50° C. and 500° C., especially at least 20° C. and 250° C., can be uniquely assigned to a temperature, wherein the determination tolerance of the temperature characteristic leads to a deviation in the temperature determination of maximum 10 K, especially maximum 5 K, advantageously maximum 1 K. In particular the sensor unit is provided, with the aid of the further sensor element, to determine a temperature characteristic of the light-guiding element. In particular the further sensor element is embodied as a temperature sensor, especially as a temperature-dependent resistor, preferably as an NTC thermistor. As an alternative it is conceivable for the sensor unit to be provided, with the aid of the further sensor element, for determining a transmissivity of the light-guiding element. In particular a number of further sensor elements are provided for a number of light-guiding elements. The inventive embodiment especially enables an improved measurement to be achieved. In particular additional parameters, such as especially a current temperature of the light-guiding element, can be included in a determination of the relevant temperature characteristic.

It is further proposed that at least one light-guiding element is embodied as a heating zone delimitation unit. Advantageously the sensor unit has at least one sensor element which is provided to determine at least one characteristic, especially a temperature characteristic of the heating zone delimitation unit. A "heating zone delimitation unit" is especially to be understood as a unit which is provided for at least partly delimiting a heating zone, especially a cooking compartment especially of an oven or of a microwave and/or a cooking zone. Advantageously the heating zone delimitation unit is embodied as a plate unit. In particular the light-guiding element is embodied as a hob plate. In particular the heating zone delimitation unit is a least partly absorbent at least in the area of visible light, especially tinted. In particular the light-guiding element, on a side facing away from a heating zone, has at least one preferably color-emitting and/or structuring coating. In particular the coating is embodied as a filter element. In particular the coating is provided to absorb light at least partly in visible light. Preferably the coating is transparent at least in the infrared spectral range, especially at least between 1.2 and 2.6 μm, preferably at least between 1.2 μm and 1.7 μm. In such an embodiment the invention is able to be used especially advantageously, wherein an improved temperature determination becomes possible.

It is further proposed that at least one light-guiding element is embodied as part of a light-guiding unit. Preferably the sensor unit has at least one sensor element which is provided to determine at least one characteristic, especially a temperature characteristic of the light-guiding unit. Advantageously the light-guiding unit is provided to conduct light from a measurement point to the light sensor and/or to a beam divider unit. In particular the measurement point is formed by a surface piece of a preferably at least partly transparent heating zone delimitation unit, especially a hob plate, alternatively a cooking compartment wall. An element being "partly" transparent is especially to be understood as the element, in at least one spectral range, especially at least one spectral range with a width of at least 300 nm, preferably at least 500 nm, preferably at least 900 nm, advantageously in the range of infrared radiation, especially between 1.2 μm and 1.7 μm, advantageously between 1.2 μm and 2.6 μm, having a transparency of at least 30%, especially at least 50%, advantageously at least 70%. A "light-guiding unit" is especially to be understood as a unit which is provided to conduct light, at least in the infrared spectral range, from a first point to a second point. In particular the first and the second point are at a distance from one another of at least 5 cm, advantageously at least 10 cm, preferably at least 15 cm. In particular the light-guiding unit is provided to adapt a propagation direction of the light. In particular at least one point of the light-guiding unit, a propagation direction of the light relative to an incidence direction is rotated by at least 10°, advantageously at least 30°, preferably at least 80°. In particular the light-guiding unit has at least one reflecting and/or focusing element, especially a mirror, a prism and/or a lens. Preferably the light-guiding unit is provided to capture light from the measurement point and forward it. Preferably the light-guiding unit has at least one light-guiding fiber and/or is formed by said fiber. A "light-guiding fiber" should especially be understood as a light-guiding element which is embodied as a fiber and is provided, on the basis of total reflection, to reach a lateral light input. A fiber is especially to be understood as a preferably flexible element having a thickness which corresponds to a maximum of 20%, especially a maximum of 10%, advantageously a maximum of 5%, preferably a maximum of 1% of a length of the element. Preferably the fiber has an at least oval, preferably circular, cross-section. In particular the glass fiber has a smallest bending radius of maximum of 5 cm, especially a maximum of 4 cm, advantageously a maximum of 3 cm. In particular the light-guiding fiber is made of glass. Preferably the light-guiding fiber has a larger index of refraction in the center than in at least one edge area. In particular the index of refraction, starting from the center and moving out towards the edge, has a falling gradient. In particular the light-guiding fiber has a core fiber with a diameter of at least 200 μm, especially at least 300 μm, advantageously at least 500 μm. In particular the light-guiding fiber has a numeric aperture of at least 0.1, advantageously at least 0.2 and especially a maximum of 0.5, advantageously a maximum of 0.3. It is further conceivable that the light-guiding unit, as an alternative and/or in addition, has at least one prism and/or at least one mirror. In particular an improved temperature determination can be achieved.

It is further proposed that at least one light-guiding fiber element is embodied as part of a beam divider unit. Advantageously the sensor unit has at least one sensor element which is provided to determine at least one characteristic, especially a temperature characteristic, of the beam divider unit. In particular the sensor unit has at least one beam divider unit which is provided to divide the light which originates from a measurement point into at least two part beams and conduct it to at least two different light sensors. Advantageously the beam divider unit is provided to divide the radiation simultaneously into at least two part beams. In particular the beam divider unit is provided, to send out the part beams at an angle of at least 5°, advantageously at least 20°, preferably at least 80°, and especially at a maximum of 120° to one another. Advantageously the light sensors are disposed optically behind, advantageously optically directly behind the beam divider unit, wherein especially a first of the part beams falls directly on the first of the light sensors and a second of the part beam falls directly on a second of the light sensors. That a light sensor is disposed "directly" behind the beam divider unit should especially be understood as a distance between the beam divider unit and the light sensor being smaller than 5 cm, especially smaller than 3 cm, advantageously smaller than 1 cm, preferably smaller than 0.5 cm. As an alternative it is conceivable for the sensor unit to have at least one guiding unit which is provided to guide at least a first of the part beams from the beam divider unit to a first of the light sensors and/or a second of the part beams from the beam divider unit to a second of the light sensors. In particular the beam divider unit has at least one focusing element, especially a lens, which is provided to form at least one of the part beams. In the alternative embodiments it is conceivable for the beam divider unit to be provided to assign the radiation alternately, preferably periodically alternately, especially with a frequency greater than 1 Hz, especially greater than 10 Hz, advantageously greater than 100 Hz, preferably greater than 1000 Hz to different part beams. In particular the beam divider unit has at least one electro-optical element and/or at least one movable, especially fluctuating, tilting and/or rotating element for this purpose, especially a mirror, and an actuator in order to move the movable element. An improved temperature determination can especially be achieved.

Advantageously it is proposed that the sensor unit has at least one evaluation electronics unit, which is provided, depending on a value of the characteristic which is determined by the further sensor element, to determine a corrected relevant temperature characteristic. In particular the evaluation electronics is provided, assuming a model that takes account of reflection and/or emission of, especially infrared, light from and/or to the light-guiding fiber element as a function of a temperature of the light-guiding element, to calculate a corrected relevant temperature characteristic. In particular the evaluation electronics has at least one processing unit, advantageously at least one memory unit and an operating program is stored in the memory unit, which is provided to be executed by the processing unit. As an alternative the evaluation electronics has a least one characteristic matrix stored in the memory unit and/or an, especially multidimensional, characteristic function, which is provided to assign characteristics of the light sensor and of the at least one further sensor element to a corrected relevant temperature characteristic, taking account of an expanded absorption, reflection and/or emission model. In particular the evaluation electronics is provided to take account of reflections and multiple reflections within the light-guiding element. In particular an improved temperature determination can be achieved.

Preferably the invention is used in cooking appliances, especially cookers and/or hobs. This invention is also advantageously able to be used however in other household appliances in which non-contact temperature determination is the aim.

Further advantages emerge from the description of the drawing given below. The drawing show an exemplary embodiment of the invention. The drawing, the description and the claims contain numerous features in combination. The person skilled in the art will expediently also consider the features individually and group them into meaningful further combinations.

DETAILED DESCRIPTION OF EXEMPLARY EMBODIMENTS OF THE PRESENT INVENTION

Figure 1:
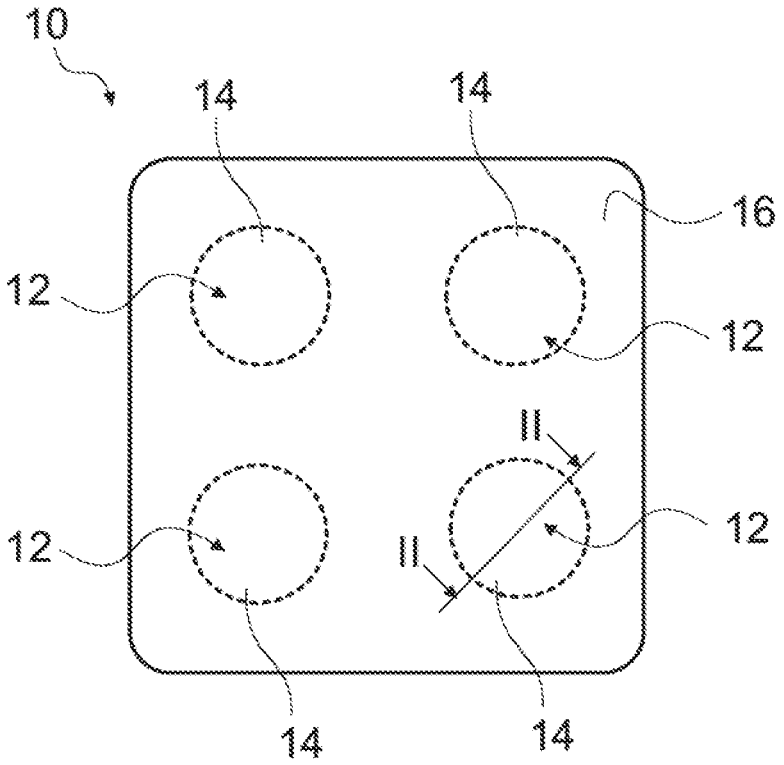
FIG. 1 shows an inventive hob in a schematic view from above.

FIG. 1 shows a domestic appliance 10 embodied as a hob with four domestic appliance apparatuses 12 each embodied as a hob apparatus. The domestic appliance 10 is embodied as an induction hob. The domestic appliance apparatuses 12 each have a heating element 14 which is disposed under a heating zone delimitation unit 16. The heating elements 14 are embodied as induction heating elements. The heating zone delimitation unit 16 is embodied as a hob plate made of glass ceramic.

Figure 3:
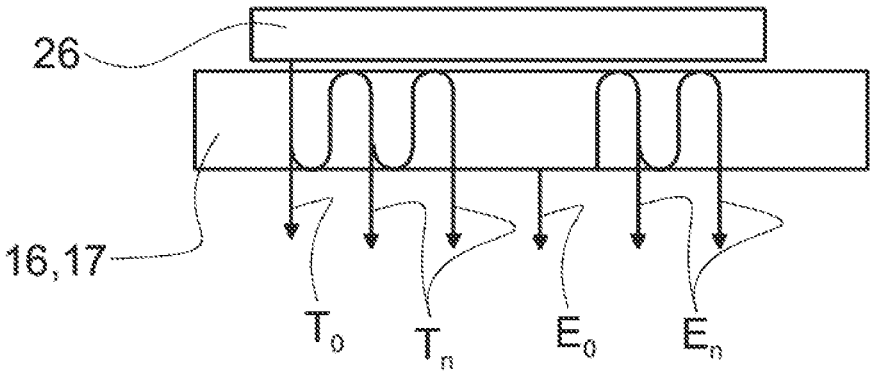
FIG. 3 shows a reflection-emission model for a hob plate in a schematic diagram.
Figure 2:
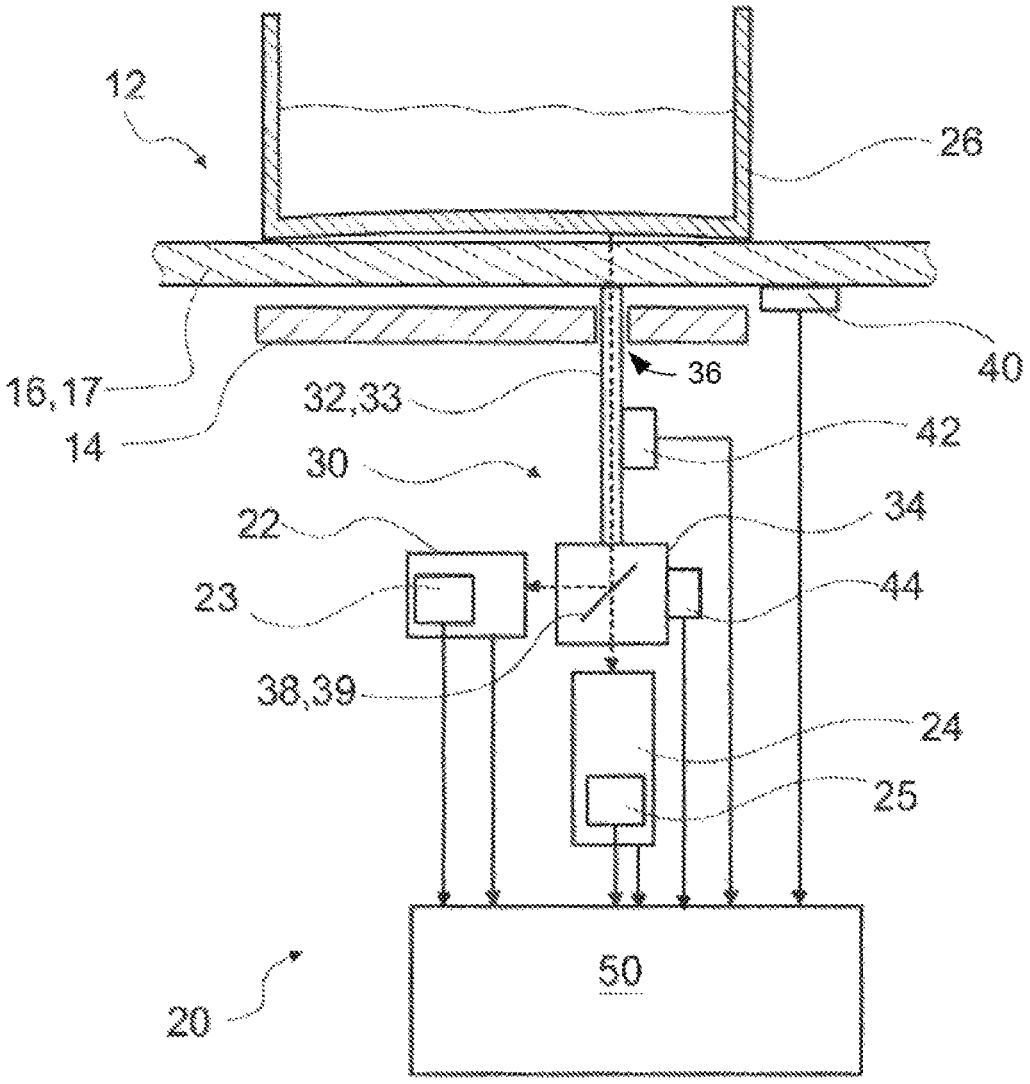
FIG. 2 shows a schematic hob apparatus in a schematic sectional view along the line II-II in FIG. 1

The domestic appliance apparatuses 12 each have a sensor unit 20 which has two light sensors 22, 24 and which is provided to detect light transmitted by an light-guiding element 17 embodied as a heating zone delimitation unit 16, in order to determine a relevant temperature characteristic of a cooking utensil 26 placed on the heating zone delimitation unit 16 (FIG. 2). The sensor unit 20 also has a light-guiding unit 30. The light-guiding unit 30 has a light-guiding element 33 embodied as a light-guiding fiber 32. The light-guiding unit 30 also has a beam divider unit 34. The light-guiding fiber 32 is provided to accept the light from a measuring point on the underside of the heating zone delimitation unit 16 and to conduct it to the beam divider unit 34. The light-guiding fiber 32 has a core diameter of 1 mm and a numerical aperture of 0.22. The light-guiding fiber is 32 is disposed in a pass-through 36 in the heating element 14. The pass-through 36 is disposed close to a center of the heating element 14. The beam divider unit 34 is provided to create two part beams from the light which is guided from the light-guiding fiber 32 to the beam divider unit 34, which is supplied to the light sensors 22, 24 of the sensor unit 20. The beam divider unit 34 has a light-guiding element 39 embodied as a part-transparent mirror 38 which is provided to create the two part beams. A filter unit is disposed between the beam divider unit 34 and the light sensors 22, 24 which is provided to filter the part beams differently. The sensor unit 20 has three further sensor elements 40, 42, 44 which are provided to determine at least temperature characteristics of the light-guiding elements 17, 33, 39. A first of the further sensor elements 40 is embodied as a PTC thermistor. The first further sensor element 40 is disposed on an underside of the heating zone delimitation unit 16 next to the heating element 14. The first sensor element 40 is provided to determine a temperature of the heating zone delimitation unit 16. A second of the two further sensor elements 42 is provided to determine a temperature of the light-guiding fiber 32. The second further sensor element 42 is embodied as an NTC thermistor. A third of the sensor elements 44 is provided to determine a temperature of the part-transparent mirror 38. The third sensor element 44 is embodied as a PTC thermistor. The light sensors 22, 24 also have temperature sensors 23, 25 which are provided to determine the temperatures of the light sensors 22, 24, in order to determine a dark current, which corrupts a measured value of the light sensors 22, 24 embodied as infrared photodiodes. The sensor unit 20 has evaluation electronics 50 which are provided, as a function of a value of the characteristics which are determined by the further sensor elements 40, 42, 44, to determine a corrected relevant temperature characteristic. The evaluation electronics 50 is provided to take account of direct transmission $T_0$ of radiation emitted by the cooking utensil 26 through the light-guiding element 17, direct emission $E_0$ from the light-guiding element 17, indirect emission $E_n$ from the light-guiding element 17 and indirect transmission $T_n$ through the light-guiding element 17 (FIG. 3).

In alternate embodiments two light-guiding units are used instead of one light-guiding unit in combination with a beam divider unit or measurements are taken with just one sensor and/or a light-guiding unit or light-guiding fiber is dispensed with. It is further conceivable for only one or two or also more than three further sensor elements to be provided in order to determine characteristics, especially temperature characteristics of the light-guiding elements.

The invention claimed is:

1. A domestic appliance apparatus, comprising:

at least one light-guiding element; and at least one sensor unit having at least one light sensor and configured to detect light transmitted through the light-guiding element and to determine at least one temperature characteristic, said at least one sensor unit having at least one sensor element configured to determine at least one characteristic of the at least one light-guiding element.

2. The domestic appliance apparatus of claim 1, constructed in the form of a hob apparatus.

3. The domestic appliance apparatus of claim 1, wherein the light-guiding element is configured as a heating zone delimitation unit.

4. The domestic appliance apparatus of claim 1, wherein the light-guiding element is configured as a hob plate.

5. The domestic appliance apparatus of claim 1, wherein the at least one light-guiding element is configured as part of a light-guiding unit.

6. The domestic appliance apparatus of claim 5, wherein the at least one light-guiding element is configured as a light-guiding fiber.

7. The domestic appliance apparatus of claim 1, wherein the at least one light-guiding element is configured as part of a beam divider unit.

8. The domestic appliance apparatus of claim 1, wherein the sensor element is configured to determine the temperature characteristic of the light-guiding element.

9. The domestic appliance apparatus of claim 1, wherein the sensor unit has at least one evaluation electronics unit configured to determine a corrected relevant temperature characteristic as a function of a value of the at least one characteristic which is determined by the at least one sensor element.

10. A domestic appliance, comprising at least one domestic appliance apparatus which includes at least one light-guiding element, and at least one sensor unit having at least one light sensor and configured to detect light transmitted through the light-guiding element and to determine at least one temperature characteristic, said at least one sensor unit having at least one sensor element configured to determine at least one characteristic of the at least one light-guiding element.

11. The domestic appliance of claim 10, wherein the domestic appliance is a hob.

12. The domestic appliance of claim 10, wherein the light-guiding element is configured as a heating zone delimitation unit.

13. The domestic appliance of claim 10, wherein the light-guiding element is configured as a hob plate.

14. The domestic appliance of claim 10, wherein the at least one light-guiding element is configured as part of a light-guiding unit.

15. The domestic appliance of claim 14, wherein the at least one light-guiding element is configured as a light-guiding fiber.

16. The domestic appliance of claim 10, wherein the at least one light-guiding element is configured as part of a beam divider unit.

17. The domestic appliance of claim 10, wherein the sensor element is configured to determine the temperature characteristic of the light-guiding element.

18. The domestic appliance of claim 10, wherein the sensor unit has at least one evaluation electronics unit configured to determine a corrected relevant temperature characteristic as a function of a value of the at least one characteristic which is determined by the at least one sensor element.

19. A method for operating a domestic appliance apparatus, comprising:

detecting a light transmitted through a light-guiding element with at least one light sensor;

determining at least one characteristic of the light-guiding element and at least one relevant temperature characteristic with at least one sensor element; and determining a corrected relevant temperature characteristic, taking into account of an expanded absorption, a reflection and/or an emission model.

20. The domestic appliance apparatus of claim 1, wherein the at least one temperature characteristic of the at least one light-guiding element includes at least one temperature characteristic of the at least one light-guiding element.

21. The domestic appliance apparatus of claim 20, wherein the at least one sensor element includes a temperature sensor.

22. The domestic appliance apparatus of claim 21, wherein the temperature sensor includes a temperature-dependent resistor.

23. The domestic appliance apparatus of claim 1, wherein the at least one temperature characteristic of the at least one light-guiding element includes a transmissivity of the at least one light-guiding element.

24. The domestic appliance apparatus of claim 1, wherein the at least one light-guiding element includes a plurality of light guiding elements, wherein at least one sensor element includes a plurality of sensor elements, wherein a sensor element of the plurality of sensor elements is provided for each light guiding element of the plurality of light guiding elements.

25. The domestic appliance apparatus of claim 24, wherein the plurality of light guiding elements includes a heating zone delimitation unit, and a first sensor element of the plurality of sensor elements is disposed on an underside of the heating zone delimitation unit, and wherein the plurality of light guiding elements includes a light-guiding fiber, and a second sensor element of the plurality of sensor elements is disposed at the light-guiding fiber.

26. The domestic appliance apparatus of claim 7, wherein the at least one light sensor includes a first light sensor and a second light sensor, and wherein the beam divider unit is configured to divide the light transmitted through the light-guiding element into at least two part beams and to conduct the at least two part beams to the first light sensor and the second light sensor, respectively.

27. The domestic appliance apparatus of claim 26, wherein the beam divider unit is configured to simultaneously divide the light transmitted through the light-guiding element into the at least two part beams.

28. The domestic appliance apparatus of claim 26, wherein the beam divider unit is configured to conduct the at least two part beams at an angle with respect to one another.

29. The domestic appliance apparatus of claim 26, wherein the first light sensor and the second light sensor are disposed optically behind the beam divider unit, wherein a first beam of the at least two part beams falls directly on the first light sensor and a second beam of the at least two part beams falls directly on the second light sensor.

30. The domestic appliance apparatus of claim 21, wherein the temperature sensor includes a PTC thermistor.

31. The domestic appliance apparatus of claim 25, wherein the plurality of light guiding elements further includes a beam divider unit, and a third sensor element of the plurality of sensor elements is disposed on the beam divider unit.

32. The domestic appliance apparatus of claim 31, wherein the beam divider unit is a part-transparent mirror.

33. The domestic appliance apparatus of claim 7, wherein the at least one light sensor includes a first light sensor and a second light sensor disposed optically behind the beam divider unit, and wherein the at least one sensor element includes a first temperature sensor on the first light sensor and a second temperature sensor on the second light sensor.

34. The domestic appliance apparatus of claim 1, wherein the at least one light sensor detects electromagnetic radiation of light transmitted by the at least one light-guiding element, and wherein the at least one sensor element includes a temperature-dependent resistor that determines the at least one characteristic of the at least one light-guiding element.

35. The domestic appliance apparatus of claim 1, wherein the at least one light sensor detects electromagnetic radiation of light transmitted by the at least one light-guiding element, and wherein the at least one sensor element determines a transmissivity of the at least one light-guiding element.

36. The domestic appliance apparatus of claim 1, wherein the at least one light sensor is disposed at an end of the at least one light-guiding element and detects electromagnetic radiation of light transmitted by the at least one light-guiding element, and wherein the at least one sensor element is disposed on a surface of the at least one light-guiding element and determines the at least one characteristic of the at least one light-guiding element.

37. The domestic appliance apparatus of claim 1, wherein the at least one sensor element includes one of:

a temperature-dependent resistor that determines the at least one characteristic of the at least one light-guiding element; and a further sensor element that determines a transmissivity of the at least one light-guiding element.

* * * * *